US010204636B2

(12) United States Patent
Chuang et al.

(10) Patent No.: US 10,204,636 B2
(45) Date of Patent: Feb. 12, 2019

(54) COMBO-PLUG DETECTING CIRCUIT AND OPERATIONAL METHOD THEREOF

(71) Applicant: REALTEK SEMICONDUCTOR CORP., Hsinchu (TW)

(72) Inventors: Tsung-Peng Chuang, Hsinchu County (TW); Chia-Chi Tsai, Hsinchu County (TW); Cheng-Pin Chang, Taipei (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 16/011,507

(22) Filed: Jun. 18, 2018

(65) Prior Publication Data

US 2019/0013035 A1 Jan. 10, 2019

(30) Foreign Application Priority Data

Jul. 10, 2017 (TW) ..... 106123048 A

(51) Int. Cl.

| | |
|---|---|
| ***H04R 29/00*** | (2006.01) |
| ***G10L 19/22*** | (2013.01) |
| ***H04S 3/00*** | (2006.01) |
| ***H04S 7/00*** | (2006.01) |

(52) U.S. Cl.

CPC ..... *G10L 19/22* (2013.01); *H04R 29/00* (2013.01); *H04S 3/008* (2013.01); *H04S 7/30* (2013.01); *H04S 2400/15* (2013.01)

(58) Field of Classification Search

CPC ..... G10L 19/22; H04R 29/00; H04S 3/008; H04S 7/30

See application file for complete search history.

(56) References Cited

U.S. PATENT DOCUMENTS

| | | | | |
|---|---|---|---|---|
| 9,479,863 | B2 | 10/2016 | Chien | |
| 2010/0260341 | A1* | 10/2010 | Sander | H04R 1/1041 381/1 |
| 2012/0200172 | A1* | 8/2012 | Johnson | H04R 29/001 307/116 |

* cited by examiner

*Primary Examiner* — Simon King

(74) *Attorney, Agent, or Firm* — Li & Cai Intellectual Property (USA) Office

(57) ABSTRACT

A combo-plug detecting circuit for use in an audio CODEC is provided. The combo-plug detecting circuit is used to determine the contact configuration of the audio plug, to ensure that the audio plug belonging to the differential structure can be compatible with the audio CODEC.

14 Claims, 5 Drawing Sheets

COMBO-PLUG DETECTING CIRCUIT AND OPERATIONAL METHOD THEREOF

1. FIELD OF THE INVENTION

The present disclosure relates to a combo-plug detecting circuit and an operational method thereof; more particularly, to a combo-plug detecting circuit and an operational method thereof applied in an audio CODEC.

2. DESCRIPTION OF RELATED ART

Generally speaking, when the audio plug of an audio input device (e.g., earphone) is connected with an audio CODEC, the audio CODEC should be able to identify the contact configuration of the audio plug, so that the audio CODEC can be, according to the contact configuration of the audio plug, tuned to a suitable audio signal output mode. For example, the primary contact configurations of audio plug that can be found on the market are three-ring structure (e.g., TRS) or four-ring structure (e.g., a Cellular Telecommunications Industry Association (CTIA) structure or an Open Mobile Terminal Platform (OMTP) structure), and the currently available audio CODECs may only self-detect audio output devices with TRS structure, CTIA structure or OMTP structure. However, some audio output devices with higher level audio plug structures (e.g., differential structure) cannot be compatible with the current audio CODEC since they have different structures from the above-mentioned three structures.

Therefore, providing a combo-plug detecting circuit that can be applied in an audio CODEC, and that is not only capable of determining the contact configuration of the audio plug, but also capable of allowing the audio plug with differential structure to be compatible with the current audio CODEC, is of significant importance in the relevant industry.

SUMMARY OF THE INVENTION

A combo-plug detecting circuit applied in an audio CODEC is provided in the present disclosure. The combo-plug detecting circuit electrically connects with an audio plug of an audio output device, in which the audio plug includes a plurality of contact points and the plurality of contact points include a top contact point, a first ring contact point, a second ring contact point and a sleeve contact point. The combo-plug detecting circuit includes a detection and control circuit and a differential signal amplifier. The combo-plug detecting circuit is configured to electrically conduct two paths respectively from the sleeve contact point to the second ring contact point and from the second ring contact point to the sleeve contact point by a designated voltage source and a bias resistor to obtain a first impedance and a second impedance, to determine a contact configuration of the audio plug according to the first impedance and the second impedance, and to output at least one control signal according to the contact configuration. The differential signal amplifier couples with the detection and control circuit, and is configured to receive the control signal, in which when the detection and control circuit determines the contact configuration of the audio plug to be a differential structure, the differential signal amplifier respectively inputs a left channel positive audio signal, a left channel negative audio signal, a right channel positive audio signal and a right channel negative audio signal to the plurality of contact points of the audio plug according to the control signal.

An operational method of combo-plug detecting circuit applied in an audio CODEC is also provided in the present disclosure. The combo-plug detecting circuit electrically connects with an audio plug of an audio output device, in which the audio plug includes a plurality of contact points and the plurality of contact points include a top contact point, a first ring contact point, a second ring contact point and a sleeve contact point. The operational method includes the following steps. Firstly, by a detection and control circuit, electrically conducting two paths respectively from the sleeve contact point to the second ring contact point and from the second ring contact point to the sleeve contact point by a designated voltage source and a bias resistor to obtain a first impedance and a second impedance, to determine a contact configuration of the audio plug according to the first impedance and the second impedance, and to output at least one control signal according to the contact configuration. Next, when the detection and control circuit determines that the contact configuration of the audio plug is of a differential structure, by a differential signal amplifier and according to the control signal, inputting a left channel positive audio signal, a left channel negative audio signal, a right channel positive audio signal and a right channel negative audio signal to the plurality of contact points of the audio plug according to the control signal.

In sum, the combo-plug detecting circuit and an operational method thereof as provided in the present disclosure is not only capable of determining the contact configuration of the audio plug, but also capable of allowing the audio plug with differential structure to be compatible with the current audio CODEC.

In order to further the understanding of the present disclosure, the following embodiments are provided along with illustrations to facilitate the disclosure of the present disclosure.

DETAILED DESCRIPTION OF THE PREFERRED EMBODIMENTS

The aforementioned illustrations and following detailed description are exemplary for the purpose of further explaining the scope of the present disclosure. Other objectives and advantages related to the present disclosure will be illustrated in the following description and appended drawings.

Figure 1A:
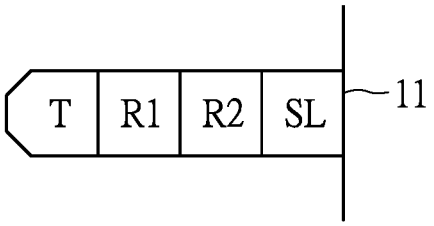
FIG. 1A is a schematic view illustrating the audio plug structure according to an embodiment of the present disclosure.
Figure 1B:
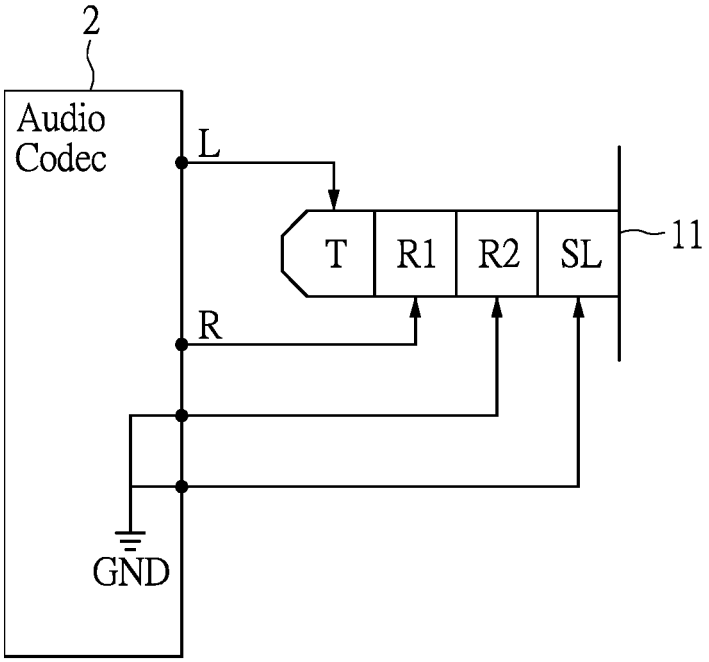
FIG. 1B is a schematic view illustrating the operation when the contact configuration of the audio plug as shown in FIG. 1A is a TRS structure.
Figure 1C:
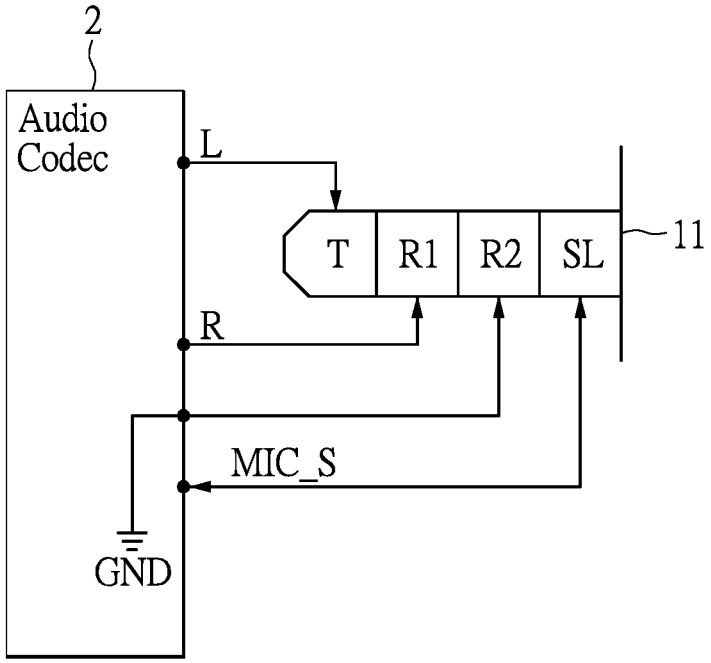
FIG. 1C is a schematic view illustrating the operation when the contact configuration of the audio plug as shown in FIG. 1A is a CTIA structure.
Figure 1D:
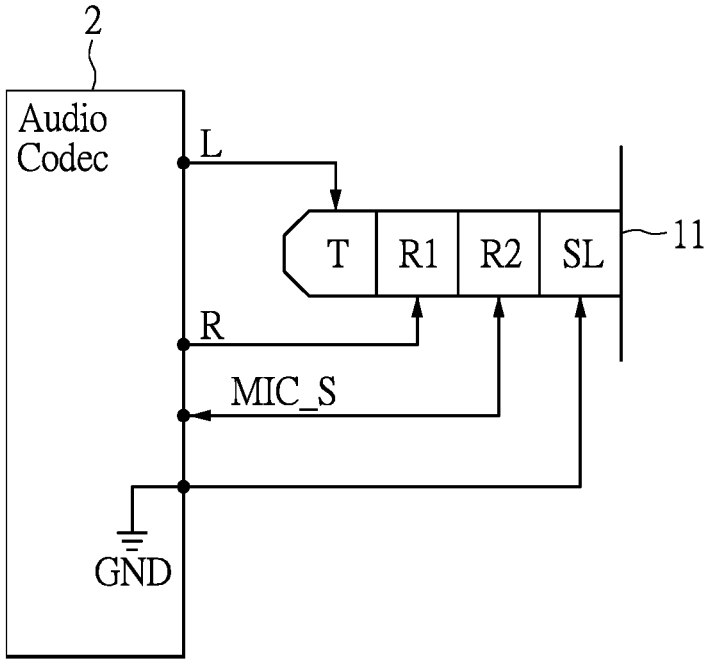
FIG. 1D is a schematic view illustrating the operation when the contact configuration of the audio plug as shown in FIG. 1A is an OMTP structure.

Reference is made to FIGS. 1A-1D, where FIG. 1A is a schematic view illustrating the audio plug structure according to an embodiment of the present disclosure, and FIGS. 1B-1D explain the operation when the audio plug 11 as shown in FIG. 1A is of different types of configurations (e.g., TRS structure, CTIA structure and OMTP structure). In the present embodiment, the audio plug 11 of an audio output device (not shown in the figure) includes a plurality of contact points. The plurality of contact points include a top contact point T, a first ring contact point R1, a second ring contact point R2 and a sleeve contact point SL. It should be noted that the implementation of the audio output device is not limited, and one with ordinary skill in the art can have different designs for the audio output device to meet different demands.

To be more specific, as shown in FIG. 1B, when the contact configuration of the audio plug is a TRS structure, the top contact point T receives a left channel audio signal L provided by the audio CODEC 2, the first ring contact point R1 receives a right channel audio signal L provided by the audio CODEC 2, and the second ring contact point R2 and the sleeve contact point SL are collectively coupled to a ground voltage GND in the audio CODEC 2. It should be noted that the implementation of how the audio CODEC 2 provides the left and right channel audio signals is not limited, and one with ordinary skill in the art can have different designs for the implementation to meet different demands.

Furthermore, as shown in FIGS. 1C and 1D, when the contact configuration of the audio plug 11 is a CTIA structure or an OMTP structure, the top contact point T and the first ring contact point R1 still respectively receive the left channel audio signal L and the right channel audio signal R provided by the audio CODEC 2; however, one of the second ring contact point R2 and sleeve contact point SL would be selected as a contact point to output a microphone sound signal MIC_S. The operation principle of the TRS structure, the CTIA structure and the OMTP structure audio plug 11 are well known to people with ordinary skill in the art, and are thus omitted for the sake of brevity.

In the present embodiment, when the contact configuration of the audio plug 11 is a differential structure, the top contact point T, the first ring contact point R1, the second ring contact point R2 and sleeve contact point SL respectively serve as a contact point to respectively receive a left channel positive audio signal L+, a left channel negative audio signal L−, a right channel positive audio signal R+ and a right channel negative audio signal R−. For example, in one of the applications, the top contact point T and the first ring contact point R1 respectively receive the left channel positive audio signal L+ and the left channel negative audio signal L−, and the second ring contact point R2 and the sleeve contact point SL respectively receive the right channel positive audio signal R+ and the right channel negative audio signal R−.

In other applications, the top contact point T and the first ring contact point R1 respectively receive the left channel positive audio signal L+ and the right channel positive audio signal R+, and the second ring contact point R2 and the sleeve contact point SL respectively receive the left channel negative audio signal L− and the right channel negative audio signal R−. In sum, the operational theory and the implementation are not limited when the audio plug 11 is a differential structure, and one with ordinary skill in the art can have different designs for implementation to meet different demands.

Figure 2:
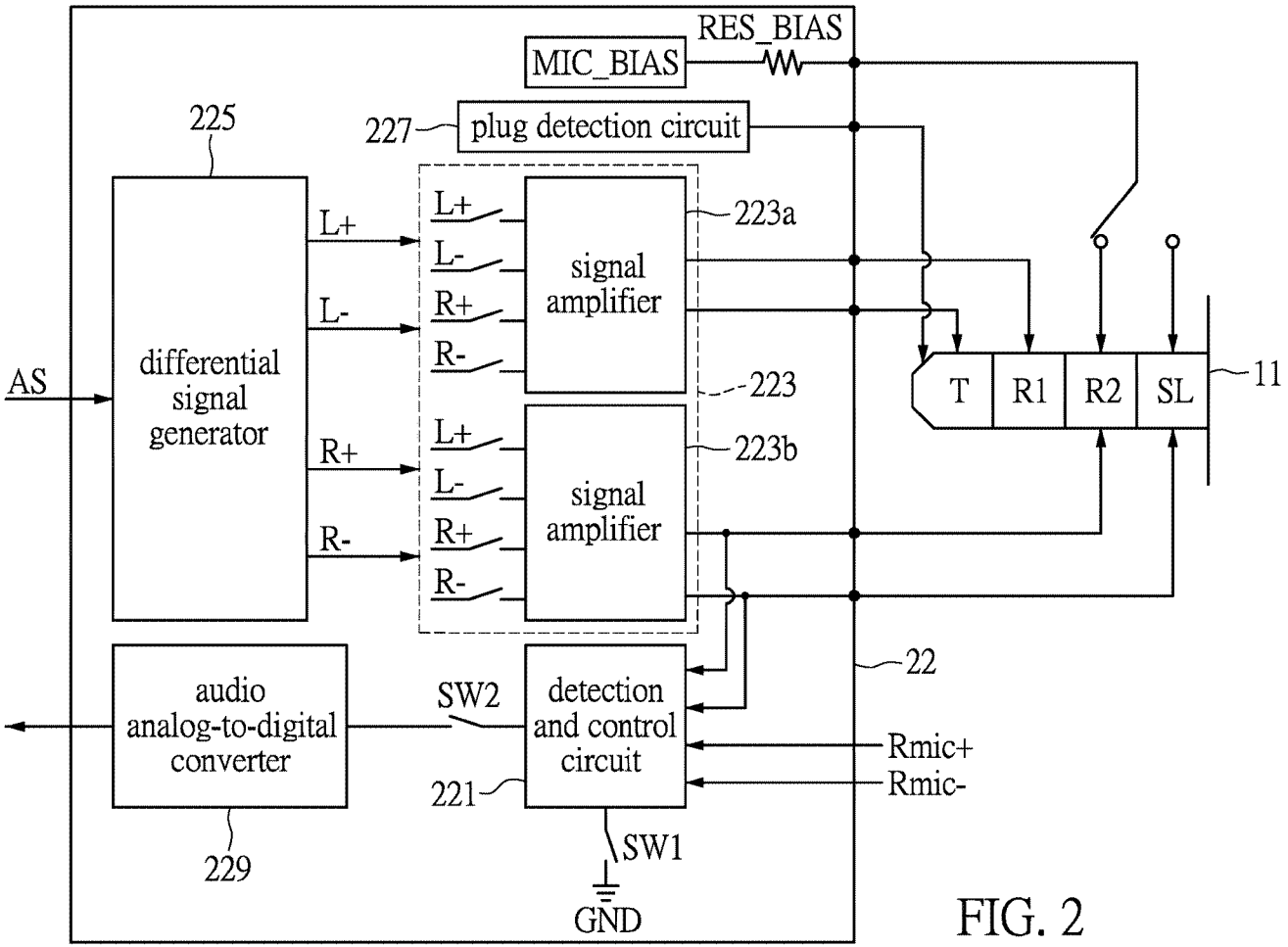
FIG. 2 is a schematic view illustrating the combo-plug detecting circuit according to an embodiment of the present disclosure.

However, for a differential structure audio plug 11, the current technique is unable to make the audio plug with differential structure compatible with the audio CODEC 2. Reference is next made to FIG. 2, where FIG. 2 is a schematic view illustrating the combo-plug detecting circuit according to an embodiment of the present disclosure. The combo-plug detecting circuit 22 as shown in FIG. 2 can also be applied in the audio CODEC 2 as shown in FIGS. 1B and 1D, and FIGS. 1B and 1D are thus referred to collectively for ease of illustration. However, the combo-plug detecting circuit 22 is not limited to being applied in the audio CODEC 2 as shown in FIGS. 1B and 1D.

It should also be noted that, the combo-plug detecting circuit 22 as shown in FIG. 2 can be directed embedded in the audio CODEC 2, instead of being an external circuit connected with the audio CODEC 2. In sum, the implementations of the combo-plug detecting circuit 22 and the audio CODEC 2 are not limited, and one with ordinary skill in the art can have different designs for implementation to meet different demands.

Precisely speaking, the combo-plug detecting circuit 22 includes a detection and control circuit 221 and a differential signal amplifier 223 coupled with the detection and control circuit 221. The above mentioned circuit can be implemented purely by hardware, or by hardware and software. In sum, the implementations of the detection and control circuit 221 and the differential signal amplifier 223 are not limited, they can be integrated or separately installed, and one with ordinary skill in the art can have different designs for implementation to meet different demands.

In practice, since the contact configuration of the audio plug 11 as shown in FIG. 2 is presumed to be unknown, the combo-plug detecting circuit 22 is used to electrically connect with the audio plug 11, and is capable of detecting the contact configuration of the audio plug 11. As shown in FIG. 2, when an audio output device is connected with the combo-plug detecting circuit 22 through the audio plug 11 of FIG. 1A, the detection and control circuit 221 would electrically conduct two paths respectively from the sleeve contact point SL to the second ring contact point R2 and from the second ring contact point R2 to the sleeve contact point SL by a designated voltage source MIC_BIAS and a bias resistor RES_BIAS to obtain a first impedance Rmic+ and a second impedance Rmic−, determine a contact configuration of the audio plug 11 according to the first impedance Rmic+ and the second impedance Rmic−, and output at least one control signal (not shown in the figure) according to the contact configuration. Details concerning the mechanism of determination will be described in the following.

When the detection and control circuit 22 determines that the contact configuration of the audio plug 11 is a differential structure, the differential signal amplifier 223, according to the control signal, respectively inputs the left channel positive audio signal L+, the left channel negative audio signal L−, the right channel positive audio signal R+ and the right channel negative audio signal R− to the contact points of the audio plug 11. As mentioned earlier, since the operational theory and the implementation are not limited when the audio plug 11 is a differential structure, each of the contact points of the audio plug 11 may selectively and non-repeatedly receive one of the left channel positive audio signal L+, the left channel negative audio signal L−, the right channel positive audio signal R+ and the right channel negative audio signal R−.

Referring to FIG. 2, two signal amplifiers 223*a* and 223*b* are utilized in the differential signal amplifier 223, and each of the signal amplifiers 223*a* and 223*b* will non-repeatedly select arbitrary two from the left channel positive audio signal L+, the left channel negative audio signal L−, the right channel positive audio signal R+ and the right channel negative audio signal R− as the input signal. It should be noted that, the implementation of the differential signal amplifier 223 as shown in FIG. 2 is not limited, and one with ordinary skill in the art can have different designs for implementation to meet different demands.

It can be understood from FIGS. 1B and 1D that, since the output signal provided by the audio CODEC 2 can only be the left channel audio signal L and the right channel audio signal R, thus, in the present embodiment, the combo-plug detecting circuit 22 can further include a differential signal generator 225 coupled with the differential signal amplifier 223. The differential signal generator 225 is configured to receive a digital audio stream AS provided by the audio CODEC 2, and to generate a left channel positive audio signal L+, the left channel negative audio signal L−, the right channel positive audio signal R+ and the right channel negative audio signal R−according to the digital audio stream AS.

It should be understood that, the digital audio stream AS shown in FIG. 2 may be, for example, but not limited to, an integration of the left channel audio single L and the right channel audio signal R provided by the audio CODEC 2. Moreover, since the current audio CODEC 2 is additionally equipped with an independent detection mechanism to detect whether a plug is plugged in, the combo-plug detecting circuit 22 according to an embodiment of the present disclosure may further include a plug detection circuit 227. The plug detection circuit 227 is configured to detect whether the audio plug 11 is electrically connected with the combo-plug detecting circuit 22.

That is to say, the plug detection circuit 227 is configured to detect whether the audio plug 11 is plugged into a socket (not shown in the figure) of the combo-plug detecting circuit 22. Only when the plug detection circuit 227 detects that the audio plug 11 is electrically connected with the combo-plug detecting circuit 22 will the plug detection circuit 227 be enabled and, co-working with the control circuit 221, electrically conduct two paths respectively from the sleeve contact point SL to the second ring contact point R2 and from the second ring contact point R2 to the sleeve contact point SL, and to determine the contact configuration of the audio plug 11 according to the first impedance Rmic+ and the second impedance Rmic−.

In practice, the plug detection circuit 227, according to the voltage change on the top contact point T, determines whether the audio plug 11 electrically contacts with the combo-plug detecting circuit 22. It is worthwhile to note that the implementation of the plug detection circuit 227 is not limited, and the above addressed is only for exemplary purpose.

In considering that the contact configuration of the audio plug 11 can still be of a IRS structure, a CTIA structure or an OMTP structure, the combo-plug detecting circuit 22 of the present disclosure can be matched with different technical means, to make sure that the current three-ring and four-ring structure can be compatible with the audio CODEC 2. That is, when the detection and control circuit 221 determines that the contact configuration of the audio plug 11 is a TRS structure, the differential signal amplifier 223 respectively inputs the left channel positive audio signal L+ and the right channel positive audio signal R+into the top contact point T and the first ring contact point R1 according to the control signal provided by the detection and control circuit 221, and connects the second ring contact point R2 and the sleeve contact point SL to the ground voltage GND in the combo-plug detecting circuit 22 via a first switch SW1.

Similarly, when the detection and control circuit 221 determines that the contact configuration of the audio plug 11 is an OMTP structure, the differential signal amplifier 223 respectively inputs the left channel positive audio signal L+ and the right channel positive audio signal R+ into the top contact point T and the first ring contact point R1 according to the control signal provided by the detection and control circuit 221, and respectively connects the second ring contact point R2 and the sleeve contact point SIL to an audio analog-to-digital converter (audio ADC) 229 and the ground voltage GND via a first switch and a second switch.

Moreover, when the detection and control circuit 221 determines that the contact configuration of the audio plug 11 is an CTIA structure, the differential signal amplifier 223 respectively inputs the left channel positive audio signal L+ and the right channel positive audio signal R+ into the top contact point T and the first ring contact point R1 according to the control signal provided by the detection and control circuit 221, and respectively connects the second ring contact point R2 and the sleeve contact SL to the ground voltage GND and the audio analog-to-digital converter 229 via a first switch and a second switch.

It should be understood that the signal outputted by the audio analog-to-digital converter 229 may be, for example, the microphone sound signal MIC_S processed by the analog-to-digital converter 229. In sum, when the contact configuration of the audio plug 11 is a TRS structure, a CTIA structure or an OMTP structure, the technical means and implementations of the above addressed combo-plug detecting circuit 22 are only for exemplary purposes, and thus the scope of the present disclosure should not be limited thereto.

Figure 3A:
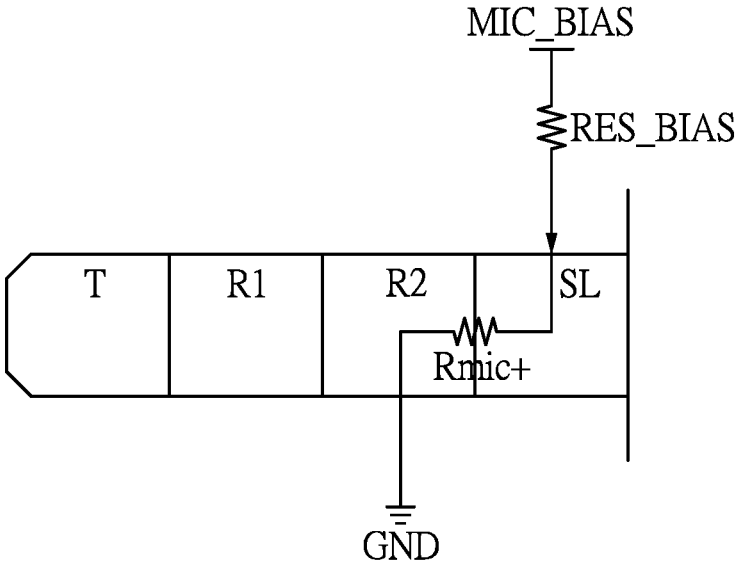
FIGS. 3A and 3B are respectively schematic views illustrating that the detection and control circuit of the combo-plug detecting circuit shown in FIG. 2 electrically conducts two paths respectively from a sleeve contact point to a second ring contact point and from the second ring contact point to the sleeve contact point.
Figure 3B:
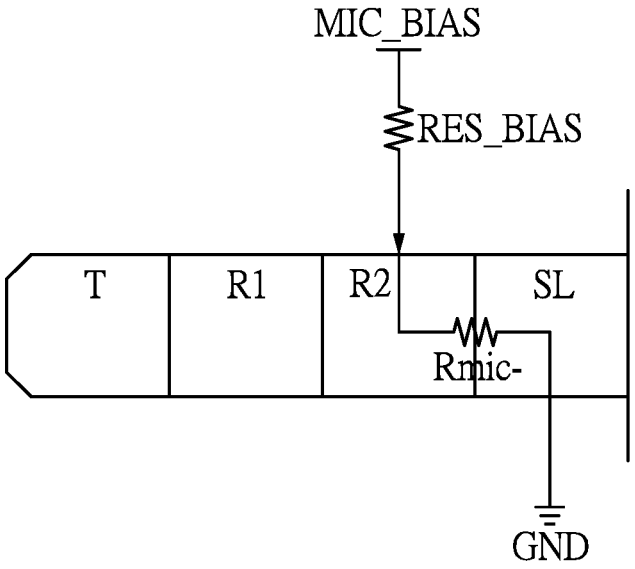

The detection mechanism executed by the detection and control circuit 221 of the combo-plug detecting circuit 22 is explained in more detail in the following. Reference is next made to FIGS. 3A and 3B, where FIGS. 3A and 3B respectively are schematic views illustrating that the detection and control circuit of the combo-plug detecting circuit shown in FIG. 2 electrically conducts two paths respectively from a sleeve contact point to a second ring contact point and from the second ring contact point to the sleeve contact point. Some of the elements shown in FIGS. 3A and 3B that have been shown in FIG. 2 will be labeled with the same element number for the sake of brevity, and the details thereof are omitted hereinafter.

Since condenser microphones have been widely used in audio output devices, the combo-plug detecting circuit 22 (or the audio CODEC 2) should provide a steady voltage source (i.e., the designated voltage source MIC_BIAS) and the bias resistor RES_BIAS to activate the condenser microphones. Furthermore, since the condenser microphones exhibit different impedances when operated under forward bias and reverse bias, the combo-plug detecting circuit 22 can directly utilize the above mentioned designated voltage source MIC_BIAS and bias resistor RES_BIAS to electrically conduct two paths respectively from the sleeve contact point to the second ring contact point (as shown in FIG. 3A) and from the second ring contact point to the sleeve contact point (as shown in FIG. 3B) to obtain a first impedance Rmic+ and a second impedance Rmic−, without increasing the cost for extra circuits.

To be more specific, the aspects as illustrated in FIGS. 3A and 3B are first used to experimentally measure the different impedances resulted from different contact configurations and, according to all of the simulation data, simulates an identification criteria for determining different contact configuration. Therefore, when the first impedance Rmic+ and the second impedance Rmic− is obtained by the detection and control circuit 221, the detection and control circuit 221 can, according to the first impedance Rmic+, the second impedance Rmic− and the identification criteria, determine the contact configuration of the audio plug 11.

For example, the data measured by experiments can be referred to Table 1 shown as follow.

TABLE 1

| Contact configuration | First impedance Rmic+ (ohm) | Second impedance Rmic− (ohm) |
|---|---|---|
| TRS structure | 0 | 0 |
| CTIA structure | K | >100 |
| OMTP structure | >100 | K |
| Differential structure A | $R_{HP}$ | $R_{HP}$ |
| Differential structure B | ∞ | ∞ |

In Table 1, K represents a fixed impedance, and $R_{HP}$ represents the intrinsic impedance of the audio output device. Differential structure A may refer to the application in which the top contact point T and the first ring contact point R1 respectively receive the left channel positive audio signal L+ and the left channel negative audio signal L−, and the second ring contact point R2 and the sleeve contact point SL respectively receive the right channel positive audio signal R+ and the right channel negative audio signal R−.

Similarly, differential structure B may refer to the application in which the top contact point T and the first ring contact point R1 respectively receive the left channel positive audio signal L+ and the right channel positive audio signal R+, and the second ring contact point R2 and the sleeve contact point SL respectively receive the left channel negative audio signal L−and the right channel negative audio signal R−.

In sum, regarding the audio plug 11 being the differential structure A, the impedance between the second ring contact point R2 and the sleeve contact point SL is the intrinsic impedance $R_{HP}$ of the audio output device. That is to say, whether operating under forward bias or reverse bias does not matter. Conversely, regarding that the audio plug 11 being the differential structure B, the impedance between the second ring contact point R2 and the sleeve contact point SL approaches infinity. It can be seen from Table 1 that, since the combinations of the first impedance Rmic+ and the second impedance Rmic− are all different from each other, the detection and control circuit 221 of the present disclosure can establish an identification criteria accordingly.

For example, when the first impedance Rmic+ and the second impedance Rmic− measured by the detection and control circuit 221 are both 0 (i.e., Rmic+=Rmic−=0), the detection and control circuit 221 can thus determine that the contact configuration of the audio plug 11 is a TRS structure plug. In other situations, for example, when the first impedance Rmic+ and the second impedance Rmic− measured by the detection and control circuit 221 are both the intrinsic impedance of the audio output device (i.e., Rmic+=Rmic−=$R_{HP}$), the detection and control circuit 221 can thus determine that the contact configuration of the audio plug 11 is a differential structure A plug. Similarly, when the first impedance Rmic+ and the second impedance Rmic− measured by the detection and control circuit 221 both approach infinity (i.e., the two paths respectively from the sleeve contact point to the second ring contact point and from the second ring contact point to the sleeve contact point are shorted, Rmic+ and Rmic− are thus represented as infinity, Rmic+=Rmic−=∞), the detection and control circuit 221 can thus determine that the contact configuration of the audio plug 11 is a differential structure LB plug.

When the first impedance Rmic+ measured by the detection and control circuit 221 is smaller than the second impedance Rmic− (i.e., Rmic+<Rmic−), the detection and control circuit 221 can thus determine that the contact configuration of the audio plug 11 is an OMTP structure plug. When the first impedance Rmic+ measured by the detection and control circuit 221 is greater than the second impedance Rmic− (i.e., Rmic+>Rmic−), the detection and control circuit 221 can thus determine that the contact configuration of the audio plug 11 is a CTIA structure plug. It should be noted that, the above addressed implementation for determining the contact configuration based on the first impedance Rmic+, the second impedance Rmic− and the criteria is only for exemplary purpose, and thus the scope of the present disclosure should not be limited thereto.

Figure 4:
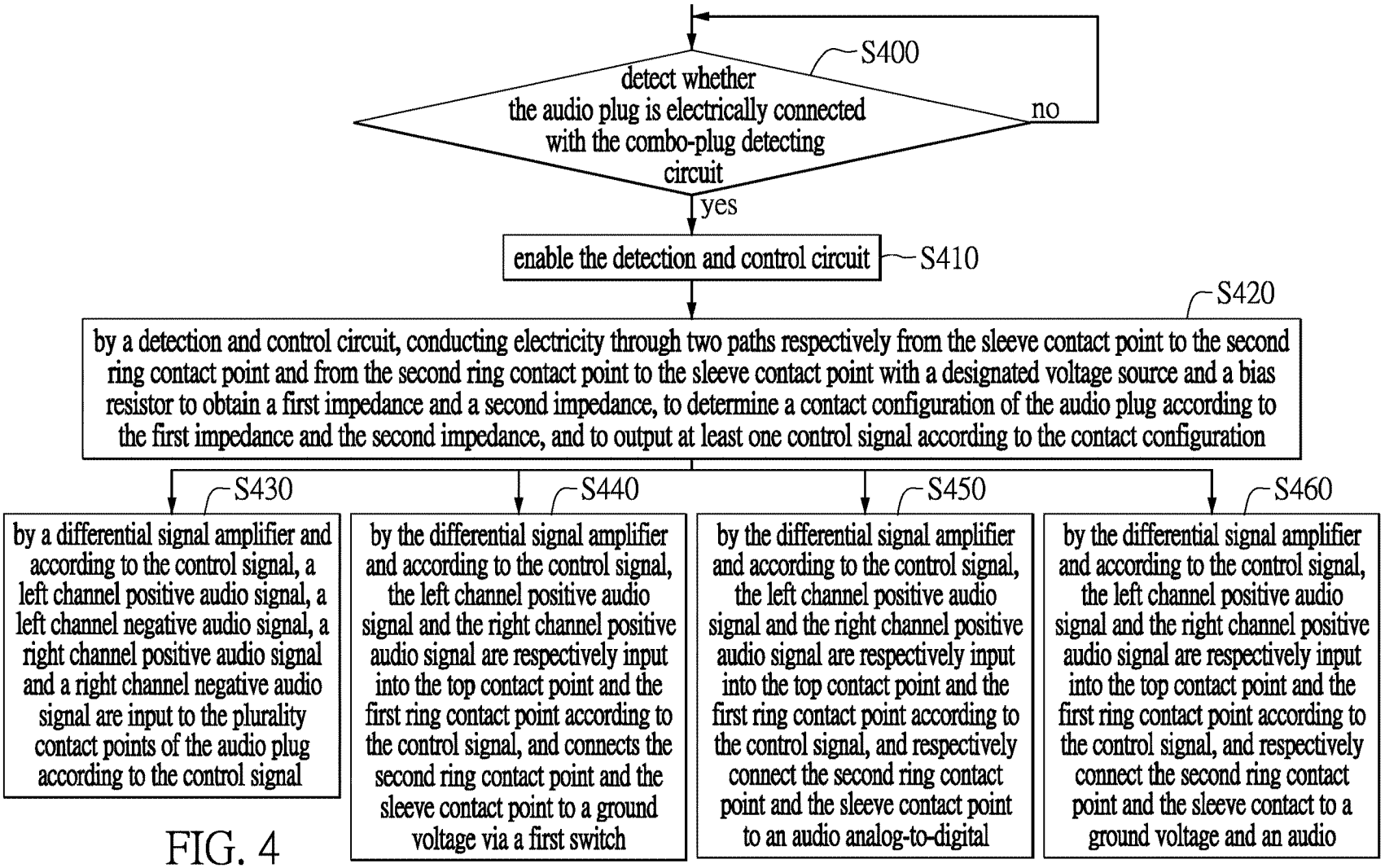
FIG. 4 is a flowchart of the operational method of combo-plug detecting circuit according to an embodiment of the present disclosure.

In order to further explain the operational flow of the combo-plug detecting circuit 22, an embodiment of operational method of combo-plug detecting circuit is further provided by the present disclosure. Reference is made to FIG. 4, where FIG. 4 is a flowchart of the operational method of combo-plug detecting circuit according to an embodiment of the present disclosure.

The operational method of the present embodiment can be applied in the combo-plug detecting circuit 22 shown in FIG. 2, FIGS. 2 to 3B are thus referred to collectively for ease of illustration. Details that are similar to the previous embodiments are omitted for the sake of brevity.

In step S400, by a plug detection circuit, whether the audio plug is electrically connected with the combo-plug detecting circuit is detected. Step S410 is performed when the audio plug is detected to be electrically connected with the combo-plug detecting circuit. In step S410, the plug detection circuit enables the detection and control circuit. Next, in step S420, by a detection and control circuit, two paths are respectively electrically conducted from the sleeve contact point to the second ring contact point and from the second ring contact point to the sleeve contact point by a designated voltage source and a bias resistor to obtain a first impedance and a second impedance, to determine a contact configuration of the audio plug according to the first impedance and the second impedance, and to output at least one control signal according to the contact configuration.

When the contact configuration of the audio plug is determined to be a differential structure, step S430 is performed. In step S430, by a differential signal amplifier and according to the control signal, a left channel positive audio signal, a left channel negative audio signal, a right channel positive audio signal and a right channel negative audio signal are input to the plurality of contact points of the audio plug according to the control signal.

When the contact configuration of the audio plug is determined to be a TRS structure, step S440 is performed. In step S440, by the differential signal amplifier and according to the control signal, the left channel positive audio signal and the right channel positive audio signal are respectively input into the top contact point and the first ring contact point according to the control signal, and connects the second ring contact point and the sleeve contact point to a ground voltage via a first switch.

When the contact configuration of the audio plug is determined to be an OMTP structure, step S450 is performed. In step S450, by the differential signal amplifier and according to the control signal, the left channel positive audio signal and the right channel positive audio signal are respectively input into the top contact point and the first ring contact point according to the control signal, and respectively connect the second ring contact point and the sleeve contact point to an audio analog-to-digital converter and a ground voltage via a first switch and a second switch.

When the contact configuration of the audio plug is determined to be a CTIA structure, step S460 is performed. In step S460, by the differential signal amplifier and according to the control signal, the left channel positive audio signal and the right channel positive audio signal are respectively input into the top contact point and the first ring contact point according to the control signal, and respectively connect the second ring contact point and the sleeve contact to a ground voltage and an audio analog-to-digital converter via a first switch and a second switch.

In considering that most of the current audio CODEC can only output digital audio stream integrated with left channel audio signal and right channel audio signal, the operational method of the present disclosure can further utilize a differential signal generator to receive a digital audio stream provided by the audio CODEC, and to generate a left channel positive audio signal, the left channel negative audio signal, the right channel positive audio signal and the right channel negative audio signal according to the digital audio stream. In sum, the implementation of generating left channel audio signal and right channel audio signal of differential form is for exemplary purpose only, and thus the scope of the present disclosure should not be limited thereto.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A combo-plug detecting circuit, applied in an audio CODEC, in which the combo-plug detecting circuit electrically connects with an audio plug of an audio output device, wherein the audio plug includes a plurality of contact points and the plurality of contact points include a top contact point, a first ring contact point, a second ring contact point and a sleeve contact point, the combo-plug detecting circuit comprising:

a detection and control circuit, configured to conduct electricity through two paths respectively from the sleeve contact point to the second ring contact point and from the second ring contact point to the sleeve contact point with a designated voltage source and a bias resistor to obtain a first impedance and a second impedance, to determine a contact configuration of the audio plug according to the first impedance and the second impedance, and to output at least one control signal according to the contact configuration; and a differential signal amplifier coupled with the detection and control circuit, configured to receive the control signal, wherein when the detection and control circuit determines the contact configuration of the audio plug to be a differential structure, the differential signal amplifier respectively inputs a left channel positive audio signal, a left channel negative audio signal, a right channel positive audio signal and a right channel negative audio signal to the plurality of contact points of the audio plug, respectively, according to the control signal.

2. The combo-plug detecting circuit according to claim 1, wherein the detection and control circuit determines whether the two paths are electrically conductive according to the first impedance and the second impedance, and when the two paths are not, or the first impedance equals to the second impedance, the detection and control circuit determines the contact configuration of the audio plug to be the differential structure.

3. The combo-plug detecting circuit according to claim 1, further comprising:

a plug detection circuit for detecting whether the audio plug is electrically connected with the combo-plug detecting circuit, wherein when the audio plug is electrically connected with the combo-plug detecting circuit, the plug detection circuit enables the detection and control circuit to electrically conduct the two paths, and to determine the contact configuration of the audio plug according to the obtained first impedance and second impedance.

4. The combo-plug detecting circuit according to claim 1, further comprising:

a differential signal generator coupled with the differential signal amplifier, configured to receive a digital audio stream provided by the audio CODEC, and to generate the left channel positive audio signal, the left channel negative audio signal, the right channel positive audio signal and the right channel negative audio signal according to the digital audio stream.

5. The combo-plug detecting circuit according to claim 1, wherein when the detection and control circuit determines that the contact configuration of the audio plug is a TRS (tip, ring, sleeve) structure, the differential signal amplifier respectively inputs the left channel positive audio signal and the right channel positive audio signal into the top contact point and the first ring contact point according to the control signal, and connects the second ring contact point and the sleeve contact point to a ground voltage via a first switch.

6. The combo-plug detecting circuit according to claim 1, wherein when the detection and control circuit determines that the contact configuration of the audio plug is an Open Mobile Terminal Platform (OMTP) structure, the differential signal amplifier respectively inputs the left channel positive audio signal and the right channel positive audio signal into the top contact point and the first ring contact point according to the control signal, and respectively connects the second ring contact point and the sleeve contact point to an audio analog-to-digital converter and a ground voltage via a first switch and a second switch.

7. The combo-plug detecting circuit according to claim 1, wherein when the detection and control circuit determines that the contact configuration of the audio plug is a Cellular Telecommunications Industry Association (CTIA) structure, the differential signal amplifier respectively inputs the left channel positive audio signal and the right channel positive audio signal into the top contact point and the first ring contact point according to the control signal, and respectively connects the second ring contact point and the sleeve contact to a ground voltage and an audio analog-to-digital converter via a first switch and a second switch.

8. An operational method of a combo-plug detecting circuit applied in an audio CODEC, in which the combo-plug detecting circuit electrically connects with an audio plug of an audio output device, wherein the audio plug includes a plurality of contact points and the plurality of contact points include a top contact point, a first ring contact point, a second ring contact point and a sleeve contact point, the operational method of the combo-plug detecting circuit comprising:

by a detection and control circuit, electrically conducting two paths respectively from the sleeve contact point to the second ring contact point and from the second ring contact point to the sleeve contact point with a designated voltage source and a bias resistor to obtain a first impedance and a second impedance, to determine a contact configuration of the audio plug according to the first impedance and the second impedance, and to output at least one control signal according to the contact configuration; and when the detection and control circuit determines that the contact configuration of the audio plug to be a differential structure, by a differential signal amplifier and according to the control signal, inputting a left channel positive audio signal, a left channel negative audio signal, a right channel positive audio signal and a right channel negative audio signal to the plurality of contact points of the audio plug, respectively, according to the control signal.

9. The operational method according to claim 8, wherein the detection and control circuit determines whether the two paths are electrically conductive according to the first impedance and the second impedance, and when the two paths are not, or when the first impedance equals to the second impedance, the detection and control circuit determines that the contact configuration of the audio plug to be the differential structure.

10. The operational method according to claim 8, further comprising:

by a plug detection circuit, detecting whether the audio plug is electrically connected with the combo-plug detecting circuit, wherein when the audio plug is electrically connected with the combo-plug detecting circuit, the plug detection circuit enables the detection and control circuit to electrically conduct the two paths, and to determine the contact configuration of the audio plug according to the obtained first impedance and second impedance.

11. The operational method according to claim 8, further comprising:

by a differential signal generator, receiving a digital audio stream provided by the audio CODEC, and generating the left channel positive audio signal, the left channel negative audio signal, the right channel positive audio signal and the right channel negative audio signal according to the digital audio stream.

12. The operational method according to claim 8, further comprising:

when the detection and control circuit determines that the contact configuration of the audio plug is a TRS (tip, ring, sleeve) structure, by the differential signal amplifier and according to the control signal, respectively inputting the left channel positive audio signal and the right channel positive audio signal into the top contact point and the first ring contact point according to the control signal, and connecting the second ring contact point and the sleeve contact point to a ground voltage via a first switch.

13. The operational method according to claim 8, further comprising:

when the detection and control circuit determines that the contact configuration of the audio plug is an Open Mobile Terminal Platform (OMTP) structure, by the differential signal amplifier and according to the control signal, respectively inputting the left channel positive audio signal and the right channel positive audio signal into the top contact point and the first ring contact point according to the control signal, and respectively connecting the second ring contact point and the sleeve contact point to an audio analog-to-digital converter and a ground voltage via a first switch and a second switch.

14. The operational method according to claim 8, further comprising:

when the detection and control circuit determines that the contact configuration of the audio plug is a Cellular Telecommunications Industry Association (CTIA) structure, by the differential signal amplifier and according to the control signal, respectively inputting the left channel positive audio signal and the right channel positive audio signal into the top contact point and the first ring contact point according to the control signal, and respectively connecting the second ring contact point and the sleeve contact to a ground voltage and an audio analog-to-digital converter via a first switch and a second switch.

* * * * *